US008992398B2

(12) United States Patent
Ross

(10) Patent No.: US 8,992,398 B2
(45) Date of Patent: Mar. 31, 2015

(54) EXERCISE DEVICE ASSEMBLY

(71) Applicant: Kim Marie Ross, Minnetonka, MN (US)

(72) Inventor: Kim Marie Ross, Minnetonka, MN (US)

( * ) Notice: Subject to any disclaimer, the term of this patent is extended or adjusted under 35 U.S.C. 154(b) by 130 days.

(21) Appl. No.: 13/735,490

(22) Filed: Jan. 7, 2013

(65) Prior Publication Data

US 2013/0178342 A1 Jul. 11, 2013

Related U.S. Application Data

(60) Provisional application No. 61/583,794, filed on Jan. 6, 2012.

(51) Int. Cl.

| | |
|---|---|
| ***A63B 21/065*** | (2006.01) |
| ***A63B 21/02*** | (2006.01) |
| ***A63B 71/00*** | (2006.01) |
| ***A63B 21/00*** | (2006.01) |
| ***A63B 21/04*** | (2006.01) |
| ***A63B 21/06*** | (2006.01) |
| ***A63B 21/072*** | (2006.01) |
| ***A63B 23/02*** | (2006.01) |
| ***A63B 23/035*** | (2006.01) |

(52) U.S. Cl.

CPC ..... *A63B 21/00116* (2013.01); *A63B 21/1484* (2013.01); *A63B 21/00189* (2013.01); *A63B 21/0407* (2013.01); *A63B 21/0603* (2013.01); *A63B 21/072* (2013.01); *A63B 21/1465* (2013.01); *A63B 21/1469* (2013.01); *A63B 21/151* (2013.01); *A63B 23/0205* (2013.01); *A63B 23/03508* (2013.01); *A63B 23/03525* (2013.01); *A63B 23/03541* (2013.01); *A63B 23/0355* (2013.01); *A63B 21/0428* (2013.01)

USPC ..... 482/121; 482/105; 482/139

(58) Field of Classification Search

USPC ..... 482/105, 92, 93, 126, 122, 121, 124, 482/125, 140–148, 23, 24, 44, 49, 50

See application file for complete search history.

(56) References Cited

U.S. PATENT DOCUMENTS

| | | | | |
|---|---|---|---|---|
| 3,966,204 | A * | 6/1976 | Dubach | 482/93 |
| 4,602,783 | A * | 7/1986 | Foland | 482/92 |
| 5,885,196 | A * | 3/1999 | Gvoich | 482/125 |
| 6,238,324 | B1 * | 5/2001 | MacMillan | 482/121 |

(Continued)

OTHER PUBLICATIONS

Amazon, "Gaiam Pilates Toning Ring Kit," http://www.amazon.com/Gaiam-Pilates-Toning-Ring-Kit/dp/B00274Q2R2/ref=sr_1_1?ie=UTF8&qid=1357587760&sr=8-1&keywords=gaiam+body+circles, 1 page, at least as early as Jan. 2013.

(Continued)

*Primary Examiner* — Loan H Thanh
*Assistant Examiner* — Megan Anderson
(74) *Attorney, Agent, or Firm* — Leanne Taveggia Farrell; Westman, Champlin & Koehler, P.A.

(57) ABSTRACT

An exercise device includes at least first and second weighted toning rings, at least one resistance cord and at least first and second clips. The first and second weighted toning rings each have a toroidal shape, an inner periphery, an outer periphery and a hook that extends outwardly from the outer periphery. The at least one resistance cord has a first end and a second end. The first clip attaches the first end of the at least one resistance cord to the hook of the first weighted toning ring and the second clip attaches the second end of the at least one resistance cord to the hook of the second weighted toning ring.

18 Claims, 5 Drawing Sheets

(56) References Cited

U.S. PATENT DOCUMENTS

| | | | | |
|---|---|---|---|---|
| 6,361,480 | B1 * | 3/2002 | Coram | 482/83 |
| 7,070,416 | B1 * | 7/2006 | Lau | 434/250 |
| 8,012,071 | B2 * | 9/2011 | Grisdale | 482/122 |
| 2011/0224055 | A1 * | 9/2011 | Kassel | 482/121 |

OTHER PUBLICATIONS

Bowflex, "Pilates bodycircles™ Kit," http://www.bowflexcatalog.com/bowflex_catalog/collections/clearance/prdcd~002-5163/Pilates+bodycircles+Kit.jsp?FOLDER%3C%3Efolder_id=2534374302040886&bmUID=1357588194917&adID=DOFG2CFEED1&gotoproduct=1&sku=002-5163, 1 page, at least as early as Jan. 2013.

Dick's Sporting Goods, "GoFit Ultimate ProGym," http://www.dickssportinggoods.com/product/index.jsp?productId=11906299&cp=4406646.4413986.4417719, 1 page, at least as early as Jan. 2013.

* cited by examiner

EXERCISE DEVICE ASSEMBLY

CROSS-REFERENCE TO RELATED APPLICATION

The present application is based on and claims the benefit of U.S. provisional patent application Ser. No. 61/583,794, filed Jan. 6, 2012, the content of which is hereby incorporated by reference in its entirety.

BACKGROUND

A variety of exercise devices are available for exercising and toning various muscles of the body. For example, exercises can be performed using free weights, barbells, weight machines and exercise "bands." Free weights and barbells include weighted ends and a handgrip or bar in the center for the user to grip. Weight machines include pulley structures, weighted plates and hydraulic or pneumatic cylinders to provide resistance to the user. Exercise "bands" utilize the concept of resistance and include springing or biasing member, which can be bent and stretched by the user.

The discussion above is merely provided for general background information and is not intended to be used as an aid in determining the scope of the claimed subject matter.

SUMMARY

An exercise kit includes at least first and second weighted toning rings, at least one resistance cord and at least first and second clips. The exercise kit can be assembled into an exercise device. The first and second weighted toning rings each have a toroidal shape, an inner periphery, an outer periphery and a hook that extends outwardly from the outer periphery. The at least one resistance cord has a first end and a second end. The first clip attaches the first end of the at least one resistance cord to the hook of the first weighted toning ring and the second clip attaches the second end of the at least one resistance cord to the hook of the second weighted toning ring.

This Summary is provided to introduce a selection of concepts in a simplified form that are further described below in the Detailed Description, This Summary is not intended to identify key features or essential features of the claimed subject matter, nor is it intended to be used as an aid in determining the scope of the claimed subject matter.

DETAILED DESCRIPTION

Embodiments described herein are directed to an exercise kit that includes at least two weighted toning rings, at least one resistance cord and mounting hardware for assembling the weighted toning rings and at least one resistance cord into an exercise device. The mounting hardware connects an end of the at least one resistance cord to one of the weighted toning rings and the opposite end of the at least one resistance cord to the another of the weighted toning rings.

To perform exercises for toning muscles of the body, a user grips a different part of their body onto each ring of the assembled exercise device. For example, a user can use their hand or hands to grip one of the rings and their foot or feet to grip the other ring. In another example, a user can grip one foot onto one of the rings and their other foot onto the other of the ring. In still another example, a user can grip one of the rings with their left hand and grip the other of the rings with their right hand. In still another example, the resistance cords can be detached and a user can insert their arms within the rings and perform arm circles in various positions.

Figure 1:
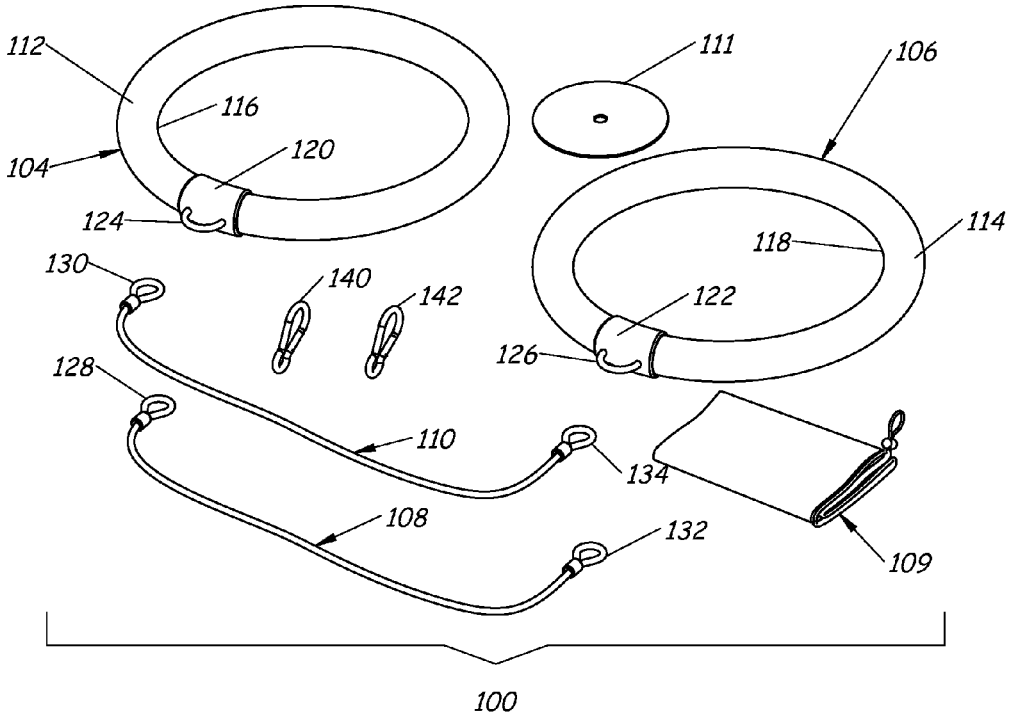
FIG. 1 is a perspective view of one embodiment of an exercise kit including components for assembling an exercise device.
Figure 2:
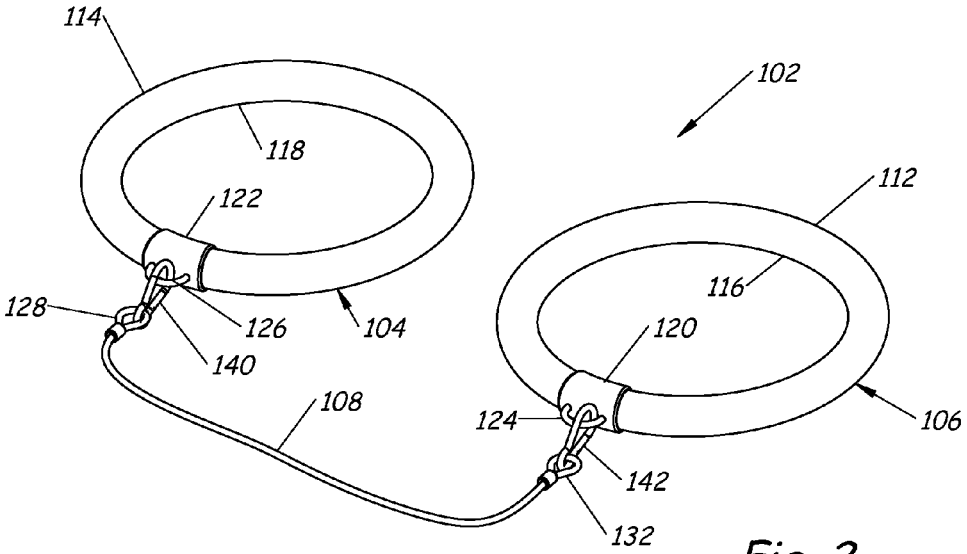
FIG. 2 is a perspective view of an exercise device constructed from the exercise kit illustrated in FIG. 1 according to one embodiment.

FIG. 1 illustrates an exercise kit 100 including components for forming an exercise device 102, while FIG. 2 illustrates one embodiment of an exercise device 102. The exercise kit 100 includes at least two toning rings 104 and 106, at least two resistance or elastic cords 108 and 110, at least two pieces of mounting hardware 140 and 142, a bag 109 and a DVD 111. Toning ring 104 is substantially identical to toning ring 106. Each toning ring 104 and 106 has a generally toroidal shape with an outer periphery 112 and 114 and an inner periphery 116 and 118. In one embodiment, each toning ring 104 and 106 is one pound in weight. However, each toning ring 104 and 106 can be of any weight including a weight that is greater than or lesser than one pound.

In one embodiment, toning rings 104 and 106 can be made of metal, plastic, wood, or any other natural or synthetic material that is either hollow or solid and is encased in a coating or covering material. The coating or covering material can be a soft, lightly resilient, but compressible foam material which is comfortable to the user. However, alternative embodiments can include a covering material that is made of a rigid plastic, a hard or soft rubber, or any other desirable material. In the instance where toning rings 104 and 106 are made of a material that is hollow, the hollow material can be filled with a weighted material, such as a gel or sand.

Each toning ring 104 and 106 includes a collar 120 and 122 that encircles and fixedly attaches to a segment of the toning ring. Each fixed collar includes an integrally formed hook 124 and 126 that extends in an outwardly direction from the outer periphery 112 and 114 of toning rings 104 or 106. However and in alternative embodiments, toning rings 104 and 106 may not include a fixed collar and instead each hook 116 and 118 can be formed integrally with toning ring 104 or 106 and still extend in an outwardly direction from the outer periphery 112 and 114 of toning rings 104 and 106.

Each resistance or elastic cord 108 and 110 includes a first end 128 and 130 and a second end 132 and 134. In one embodiment and as illustrated in FIGS. 1 and 2, first ends 128 and 130 of resistance or elastic cords 108 and 110 include closed loops and second ends 132 and 134 of resistance or elastic cords 108 and 110 include closed loops. As also illustrated in FIGS. 1 and 2, one embodiment of mounting hardware 140 and 142 includes clips, such as "C" clips, that can be spring-loaded and configured to attach to each first end 128 and 130 of resistance or elastic cords 108 and 110 to a toning ring 104 or 106 and attach each second end 132 and 134 of resistance or elastic cords 108 and 110 to a toning ring 104 or 106. The closed loops of first ends 128 and 130 and second ends 132 and 134 are configured to receive clips 140 and 142 for attachment to hooks 124 and 126. In one embodiment, resistance or elastic cords 108 and 110 can be made of bungee cord (i.e., an elastic cord composed of one or more strands of elastic that are covered in a braided woven cotton or polypropylene sheath). In other embodiments, resistance or elastic cords 108 and 110 can be made of rubber or other type of elastic tubing that does not include a sheath. Regardless of construction, resistance or elastic cords 108 and 110 are biasing members that require an applied force from each end to stretch, and when the applied force on at least one of the ends is released, the resistance or elastic cords 108 and 110 spring back into their original shape.

In one embodiment, each resistance or elastic cords 108 and 110 includes a different degree of tension. To accomplish this, each resistance or elastic cord 108 and 110 is made to provide a degree of elasticity. For example, resistance or elastic cord 108 includes a first degree of elasticity and resistance or elastic cord 110 includes a second degree of elasticity. The different degrees of elasticity of resistance of elastic cords 108 and 110 provide an assembled exercise device, such as exercise device 102, 202 or 302, with different levels of difficulty for the user. In one embodiment, the first degree of elasticity of resistance or elastic cord 108 is less than the second degree of elasticity of resistance or elastic cord 110. In other words, the amount of force or poundage that is needed to stretch resistance or elastic cord 108 is less than the amount of force or poundage that is needed to stretch resistance or elastic cord 110.

Figure 3:
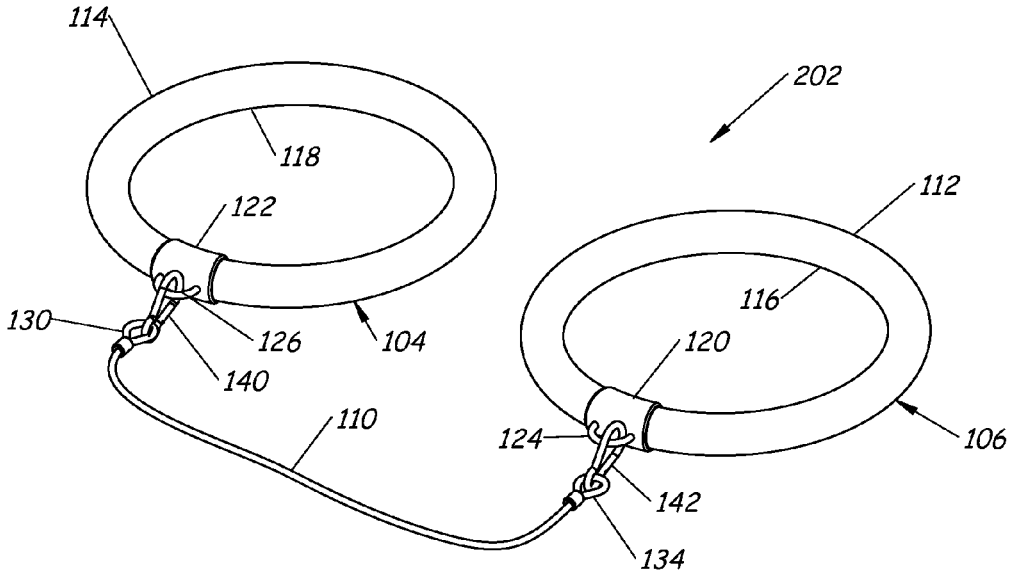
FIG. 3 is a perspective view of an exercise device constructed from the exercise kit illustrated in FIG. 1 according to another embodiment.
Figure 4:
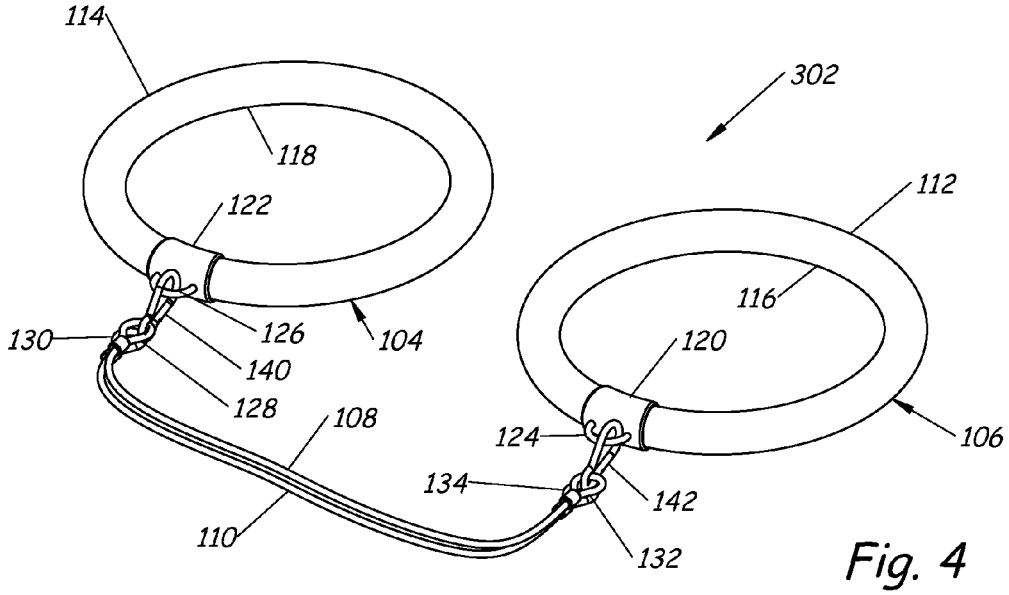
FIG. 4 is a perspective view of an exercise device constructed from the exercise kit illustrated in FIG. 1 according to another embodiment.

In FIG. 2 and in one embodiment, exercise device 102 can be configured from exercise kit 100 and includes first and second ends 128 and 132 of resistance or elastic cord 108 connected to clips 140 and 142. Clips 140 and 142 are then clipped or mounted to hooks 124 and 126 of fixed collars 120 and 122. In FIG. 3 and in another embodiment, an exercise device 202 can be configured from exercise kit 100 and includes first and second ends 130 and 134 of resistance or elastic cord 110 connected to clips 140 and 142. Clips 140 and 142 are then clipped or mounted to hooks 124 and 126 of fixed collars 120 and 122. In FIG. 4 and in yet another embodiment, an exercise device 302 can be configured from exercise kit 100 and includes first and second ends 128 and 132 of resistance or elastic cord 108 connected to clips 140 and 142 as well as first and second ends 130 and 134 of resistance or elastic cord 110 connected to clips 140 and 142. Clips 140 and 142 are then clipped or mounted to hooks 124 and 126 of fixed collars 120 and 122.

By allowing a user to only connect first resistance or elastic cord 108 to weighted toning rings 104 and 106, to only connect the second resistance or elastic cord 110 to weighted toning rings 104 and 106 or to connect both resistance or elastic cords 108 and 110 to weighted toning rings 104 and 106, the user is allowed to selectively configure the device to have three different levels of resistance or assistance for performing exercises. In FIG. 4, the use of both first resistance or elastic cord 108 and second resistance or elastic cord 110 provides a first level or a beginner level exercise device 302. In this configuration, while the user will receive the most amount of resist during performed exercises, the user will also receive the most amount of assist. In FIG. 3, the use of second resistance or elastic cord 110 provides a second level or an intermediate level exercise device 202. In this configuration, the user will receive a medium amount of resist during performed exercises, which gives the user a medium amount of assist. In FIG. 2, the use of first resistance or elastic cord 108 provides a third level or advanced level exercise device 102. In this configuration, the user will receive a low or a little amount of resist and therefore a low or a little amount of assist.

As illustrated in FIG. 1, bag 109 is a mesh bag and is configured to hold toning rings 104 and 106, resistance or elastic cords 108 and 110, clips 140 and 142 and DVD 111. In this way, exercise kit 100 can be transported and made mobile for ease of assembly in any location. DVD 111 includes video content illustrating how exercises should be properly performed using assembled exercise device 102, 202 or 302.

Figure 5:
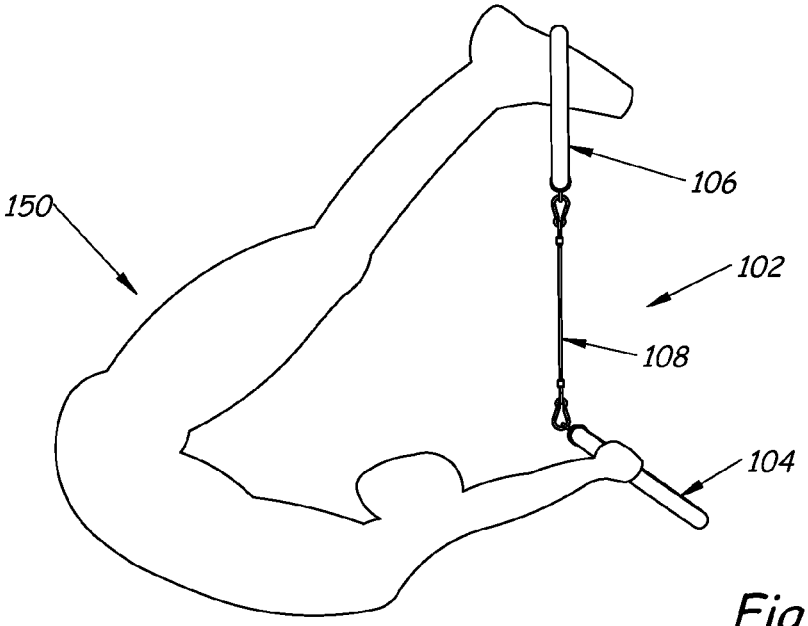
FIGS. 5-10 are illustrations of a user performing various exercises with the exercise device illustrated in FIG. 4.

As discussed above, various exercises can be performed to tone muscles of the body and in order for resistance or elastic cords 108 and/or 110 to work properly, these various exercises require that different parts of a user's body to grip onto or engage each toning ring 104 and 106. The toroidal shape of toning rings 104 and 106 provide a user multiple gripping surfaces around the circumference of the rings depending on the angle the resistance or elastic cord or cords need to be relative to the user's body to perform various exercises. In addition, the toroidal shape of toning rings 104 and 106 allow the toning rings on their own to be used to perform exercises. In one embodiment and as illustrated in FIG. 5, the user 150 has engaged toning ring 104 by gripping the toroidal shape with their hands so that the user's hands straddle the clip connection or connections. In addition, the user engages toning ring 106 by resting the inner periphery 118 of the toroidal shape along the arches of their feet. While FIG. 5 illustrates user 150 using the assistance of resistance or elastic cord 108 to pull their lower body into a Pilates position called the roll-over, which brings the lower body up and over the user's head, other exercises can be performed with both of the user's hands gripping toning ring 104 and both of the user's feet engaged with toning ring 106.

For example, another type of exercise that can be performed with both hands engaging toning ring 104 and both feet engaging toning ring 106 is based on the traditional sit up, which targets the abdominal muscles. With both of the user's feet engaged with toning ring 106 and both of the user's hands gripping toning ring 104, the user sits on the floor and with legs extended and heels resting on the floor. In this position, the traditional sit up is performed and the rings provide assist. A small twist in the torso can be added to further target oblique muscles. In another example and with the user's feet and hands remaining in the same position on the device 102 is a bench-press kick out. The bench-press kick out is an athletic-level exercise in which the beginner can do in the full range of motion with the cord or cords providing the assist. In this exercise, the user lies out such that the upper body is just slightly off the floor and the legs and feet are extended outwards and lifted slightly off the floor. The user then brings the upper body and legs together into a crunch.

In yet another example and with the user's feet and hands remaining in the same position of the device 102 is a reverse curl. In this exercise, the lower body is raised and lowered off the floor, including the small of the back, such that the legs are raised above the head and then lowered back into a neutral position. In still another example, from the roll-over position illustrated in FIG. 5, the user can move into the Pilates position called the one hundred. In this position, the legs can be raise and lowered. This is an exercise that when unassisted is difficult to do. With the aid of exercise device 102 and resistance or elastic cord 108, this exercise can be accomplished and still be highly effective in targeting the core muscles.

Figure 6:
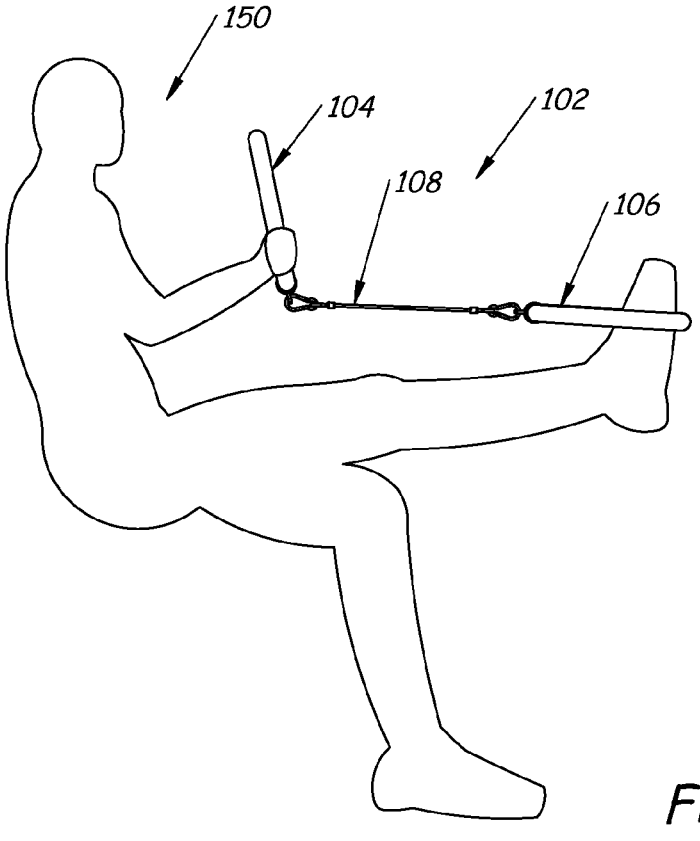

In another embodiment and as illustrated in FIG. 6, the user 150 keeps their engagement with toning ring 104 the same as in FIG. 5 (i.e., engaging toning ring 104 by gripping the toroidal shape with both their hands so that the user's hands straddle the clip connection or connections), but engages toning ring 106 by resting the inner periphery 118 of the toroidal shape along the arch of only one foot. In this position and as illustrated in FIG. 6, an exercise that can be performed includes leg extensions. For this exercise, user 150 sits on a chair and lowers and raises one leg using the resistance and assistance of resistance or elastic cord 108.

Figure 7:
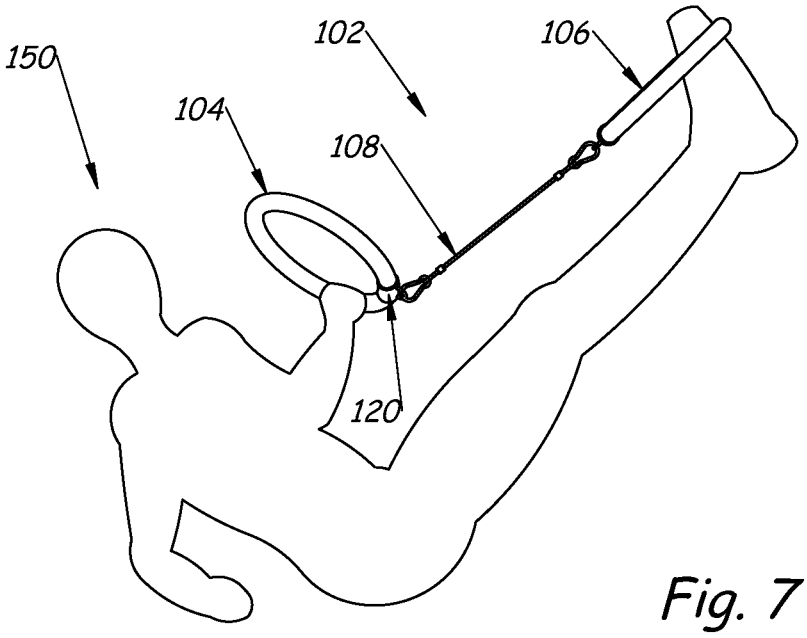

In another embodiment and as illustrated in FIG. 7, the user 150 returns their engagement of both feet to toning ring 106, but engages toning ring 104 with only one hand, such as by gripping toning ring 104 on a segment of the ring that is opposite fixed collar 120, while the unengaged arm and hand support the body on the floor. In this exercise, which is called side leg raises, both legs are held together and extended upwards to form a vee with the user's upper body. The legs are then lowered to just above the floor and subsequently lifted as illustrated in FIG. 7. This exercise targets the oblique muscles and is otherwise very difficult to do without the aid of the resist/assist components of the device.

Figure 8:
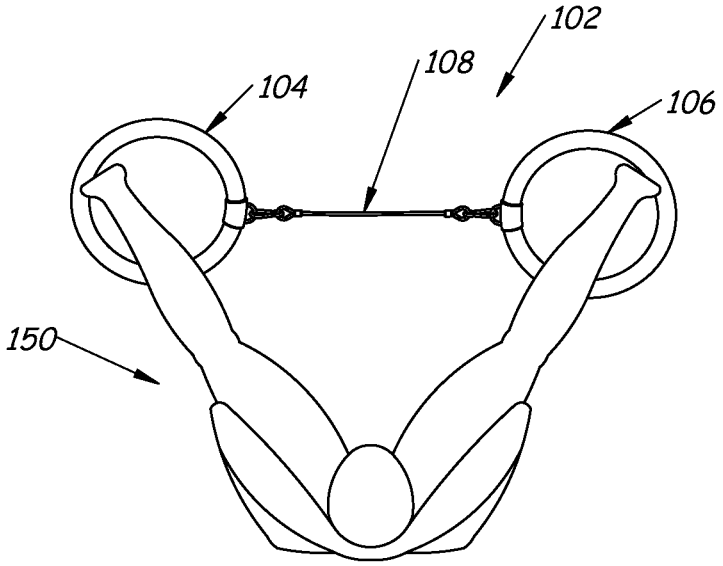

In yet another embodiment and as illustrated in FIG. 8, the user engages one foot with toning ring 104 and one foot with toning ring 106 such that the outer edges of the user's feet are resting against inner peripheries 116 and 118 of toning rings 104 and 106, while hands and arms of user 150 remain free. In addition to exercises that target the abdominal muscles, exercises can also be performed with the device for targeting the gluteal and thigh muscles. In one exercise and as illustrated in FIG. 8, the user lies on their back and extends their legs above and in alignment with their waist. From this position, the user can perform pulses where the legs are pressed outwardly and then moved inwardly as the legs form a vee-shape. With the knees slightly dropped, different muscles in the same region will be targeted. In addition, the user can prop their head up with the back of their hands/arms and lift their upper body to further work the core muscles while working the gluteals and thighs. Although not specifically illustrated, it is also possible for the user to grip one toning ring 104 with one hand and grip the other toning ring 106 with the other hand. In this way, exercises can be performed that target muscles of the upper body.

Figure 9:
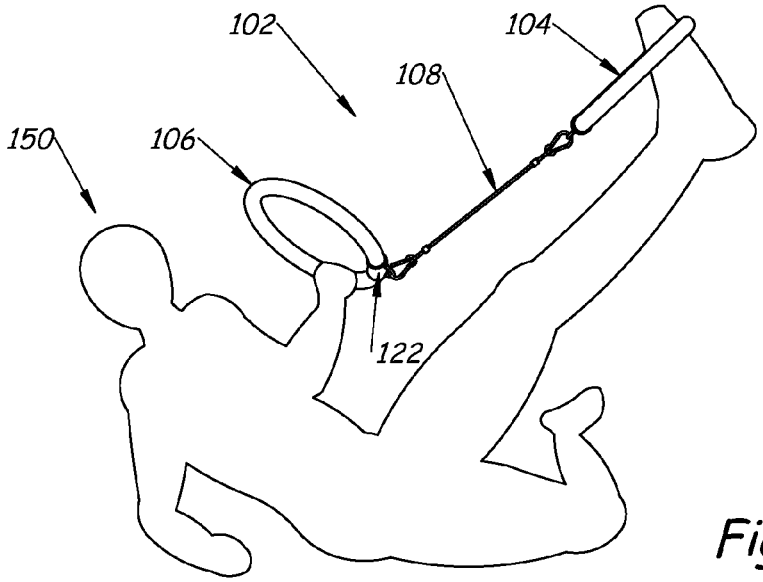

In still another embodiment and as illustrated in FIG. 9, the user 150 engages one foot with toning 104 and one hand with toning ring 106 such that the arch of the user's foot rests on the inner periphery 116 of toning ring 104 and the user grips on a segment of the ring 106 that is opposite fixed collar 122. The unengaged arms and hand support the upper body by resting on the floor and the unengaged leg and foot support the lower body by resting on the floor. This exercise is another form of leg raises where only one leg is worked at a time so as to work muscles of the gluteals and thighs.

Figure 10:
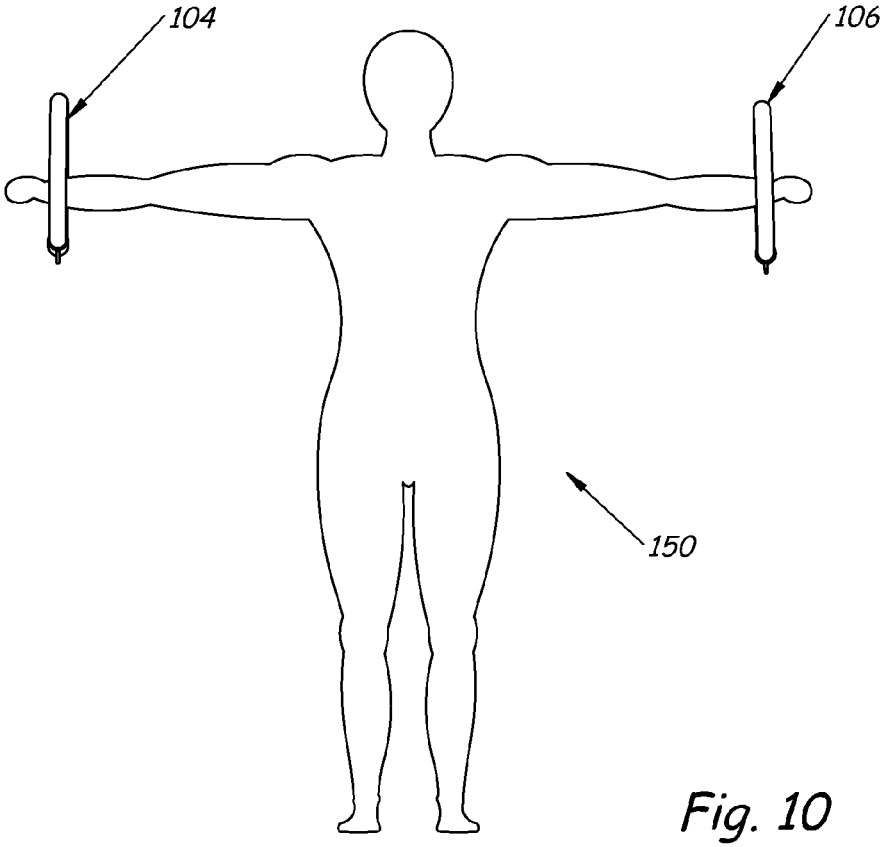

In still another embodiment and as illustrated in FIG. 10, resistance or elastic cords 108 and/or 110 are removed so as to work muscles of the arms. Each ring 104 and 106 is placed on each arm of the user 150 and circles are made with the arms. In one embodiment and as illustrated in FIG. 10, the arms can be bent with palms facing upwards to target the biceps. In another embodiment, the arms can be extended straight or bent with palms facing backwards to target the triceps. In yet another embodiment, the arms can be brought forward with palms facing forward. In this arm circling position, the pectorals or chest muscles are targeted.

Although the present invention has been described with reference to preferred embodiments, workers skilled in the art will recognize that changes may be made in form and detail without departing from the spirit and scope of the invention.

What is claimed is:

1. An exercise device comprising:

first and second weighted toning rings each made of a rigid material encased in a covering and having a toroidal shape, an inner periphery, an outer periphery and a hook that extends outwardly from the outer periphery, wherein the first and second weighted toning rings are substantially identical;

at least one resistance cord having a first end and a second end; wherein the at least one resistance cord comprises a first and second resistance cord; and first and second clips, the first clip directly attached to the hook of the first weighted toning ring and the second clip directly attached to the hook of the second weighted toning ring;

wherein the first end of the first resistance cord and the first end of the second resistance cord are directly attached to the first clip and the second end of the first resistance cord and the second end of the second resistance cord are directly attached to the second clip so that the first resistance cord and the second resistance cord are directly attached to the first and second weighted toning rings in parallel;

wherein a first force is applied to the first weighted toning ring at least one body part of the user and a second force is applied to the second weighted toning ring using at least another body part of the user to stretch the at least one resistance cord to provide resistance to the user and releasing at least one of the first force or the second force to provide assistance to the user.

2. The exercise device of claim 1, wherein the first resistance cord and the second resistance cord each comprise a degree of elasticity, wherein the degree of elasticity provides the exercise device with a level of difficulty for the user.

3. The exercise device of claim 1, wherein the first resistance cord having a degree of elasticity that is less than a degree of elasticity of the second resistance cord.

4. The exercise device of claim 1, wherein the first and second clips comprise "C" clips.

5. The exercise device of claim 1, wherein the first end of the first resistance cord and the second resistance cord comprises an enclosed loop for receiving the first clip and wherein the second end of the first resistance cord and second resistance cord comprises an enclosed loop for receiving the second clip.

6. The exercise device of claim 1, wherein the first and second weighted toning rings each include a fixed collar that encircles a segment of each weighted toning ring, each fixed collar providing the hook that is integrally formed with each fixed collar.

7. The exercise device of claim 1, wherein the first resistance cord and the second resistance cord comprise elastic cords.

8. The exercise device of claim 1, wherein each weighted toning ring comprises a weight of substantially one pound.

9. The exercise device of claim 1, wherein each weighted toning ring is made of metal and is encased in a foam material.

10. A method of assembling an exercise device comprising:

directly attaching a first end of at least one elastic cord to a first weighted toning ring made of a rigid material and encased in a covering material, the first weighted toning ring including a toroidal shape, an inner periphery and an outer periphery; and directly attaching a second end of the at least one elastic cord to a second weighted toning ring made of a rigid material and encased in a covering material, the second weighted toning ring including a toroidal shape, an inner periphery and an outer periphery.

11. The method of claim 10, wherein directly attaching the first end of the at least one elastic cord to the first weighted toning ring comprises directly attaching the first end of the at least one elastic cord to a hook located on a fixed collar that encircles a segment of the first weighted toning ring, the hook of the first weighted toning ring extending outwardly from the outer periphery of the first weighted toning ring.

12. The method of claim 11, wherein directly attaching the second end of the at least one elastic cord to the second weighted toning ring comprises directly attaching the second end of the at least one elastic cord to a hook located on a fixed collar that encircles a segment of the second weighted toning ring, the hook of the second weighted toning ring extending outwardly from the outer periphery of the second weighted toning ring.

13. The method of claim 10, wherein directly attaching the first end of the at least one elastic cord to the first weighted toning ring comprises directly attaching a first end of a first elastic cord to the first weighted toning ring and directly attaching a first end of a second elastic cord to the first weighted ring and wherein directly attaching the second end of the at least one elastic cord to the second weighted toning ring comprises directly attaching a second end of the first elastic cord to the second weight toning ring and directly attaching a second end of the second elastic cord to the second weighted toning such that the first and second elastic cords are directly attached to the first and second weighted toning rings in parallel.

14. An exercise device comprising:

a pair of weighted bodies made of rigid material that are encased in a covering material, wherein each weighted body includes a geometrical shape that is defined between an outer periphery and an inner periphery;

at least one elastic cord having a first end and a second end; and two clips including a first clip directly attached to one of the pair of weighted bodies and a second clip directly attached to the other of the pair of weighted bodies;

wherein the first end of the at least one elastic cord is directly attached to the first clip and the second end of the at least one elastic cord is directly attached to the second clip.

15. The exercise device of claim 14, wherein each of the weighted bodies comprises a ring having a toroidal shape.

16. The exercise device of claim 14, wherein each weighted body includes a collar that encircles a segment of each weighted body, each collar providing a hook that is integrally formed with the collar.

17. The exercise device of claim 14, wherein the at least one elastic cord comprises a first elastic cord having a first end and a second end and a second elastic cord having a first end and a second end, wherein the first end of the first elastic cord and the first end of the second elastic cord are directly attached to the first clip and wherein the second end of the first elastic cord and the second end of the second elastic cord are directly attached to the second clip so that the first elastic cord and the second elastic cord are directly attached to the pair of weighted bodies in parallel.

18. The exercise device of claim 14, wherein the rigid material of the pair of weighted bodies is selected from the group consisting of metal, plastic and wood.

* * * * *